United States Patent [19]

Dykstra

[11] Patent Number: 5,048,502

[45] Date of Patent: Sep. 17, 1991

[54] CAPACITIVE-DISCHARGE IGNITION SYSTEM WITH STEP TIMING ADVANCE

[75] Inventor: Richard A. Dykstra, Cedar Grove, Wis.

[73] Assignee: Briggs & Stratton Corporation, Wauwatosa, Wis.

[21] Appl. No.: 578,429

[22] Filed: Sep. 5, 1990

[51] Int. Cl.[5] ..... F02P 3/08; F02P 5/04

[52] U.S. Cl. ..... 123/602; 123/149 C

[58] Field of Search ..... 123/149 R, 149 C, 149 D, 123/599, 600, 602

[56] References Cited

U.S. PATENT DOCUMENTS

| | | | |
|---|---|---|---|
| 3,861,373 | 1/1975 | Allwang et al. | 123/601 |
| 3,941,111 | 3/1976 | Carmichael et al. | 123/149 C X |
| 4,036,201 | 7/1977 | Burson | 123/599 |
| 4,056,088 | 11/1977 | Carmichael | 123/600 |
| 4,170,977 | 10/1979 | Carmichael et al. | 123/599 X |
| 4,237,844 | 12/1980 | Lathlaen | 123/617 |
| 4,480,624 | 11/1984 | Anderson | 123/602 |
| 4,509,493 | 4/1985 | Nash | 123/602 |
| 4,576,138 | 3/1986 | Wolf | 123/600 |

FOREIGN PATENT DOCUMENTS

| | | |
|---|---|---|
| 1764253 | 4/1975 | Fed. Rep. of Germany . |
| 2582057 | 11/1986 | France . |

*Primary Examiner*—Tony M. Argenbright

*Attorney, Agent, or Firm*—Andrus, Sceales, Starke & Sawall

[57] ABSTRACT

A capacitive-discharge ignition system having a step advance is disclosed. In a preferred embodiment, the ignition thyristor is gated on at low engine speeds by a first control means in response to a primary winding output signal, and is gated on at higher engine speeds by a second control means in response to a charge winding output signal. In alternate embodiments, the first control means is responsive to a primary winding signal having a first polarity, and the second control means is responsive to a primary winding signal of the opposite polarity. The charge winding is located on a leading pole of a stator, with the primary winding disposed on a distinct, trailing pole. This arrangement enables the charge capacitor to fully charge before the ignition thyristor is gated on.

16 Claims, 2 Drawing Sheets

CAPACITIVE-DISCHARGE IGNITION SYSTEM WITH STEP TIMING ADVANCE

BACKGROUND OF THE INVENTION

This invention relates to internal combustion engines, and more particularly to small internal combustion engines of the type used to power lawnmowers, snow blowers, generators and the like.

Several types of ignition systems are known for small internal combustion engines. One such type is the capacitive-discharge ignition system, wherein a charge capacitor is charged from a current source such as a charge winding, and is discharged in response to the gating on of a thyristor in series with both the charge capacitor and with the primary winding of an output coil. The gating on of the thyristor controls discharge of the capacitor through the output coil, which triggers ignition firing.

Since the gating of the thyristor in effect controls the timing of ignition firing, control of thyristor gating may be used to retard ignition timing when the engine runs at low speeds upon starting, and to advance ignition timing when the engine runs at higher speeds. Unfortunately, typical prior art gating control techniques are complicated and expensive in that they often require additional trigger coils or a number of semiconductor switches. Although capacitive-discharge ignition systems having continuous timing advance are desirable in some applications, an inexpensive step advance system is suitable for many types of engines.

SUMMARY OF THE INVENTION

An advancing capacitive-discharge ignition system for an internal combustion engine is disclosed which comprises a charge capacitor, an ignition thyristor in circuit connection with the charge capacitor, a charge winding located on a leading pole of a stator, an ignition coil having a primary winding located on a trailing pole of a stator, first gate control means for gating on the ignition thyristor at low engine speeds, and a second gate control means for gating on the ignition thyristor at high engine speeds to advance ignition timing.

The placement of the charge winding on a leading pole of a stator and the primary winding on a trailing pole enables the charge winding to fully charge the charge capacitor before the thyristor is gated on to trigger ignition firing.

In a preferred embodiment, the first gate control means receives and is responsive to a voltage signal from the primary winding, and the second gate control means receives and is responsive to a charge winding signal. The second gate control means preferably includes a threshold-switching device such as a zener diode.

In alternate embodiments, the first gate control means receives and is responsive to a voltage signal from the primary winding of a first polarity, and the second gate control means receives and is responsive to a voltage signal from the primary winding of a second polarity that is opposite to the first polarity.

In all the disclosed embodiments, the first gate control means preferably includes a first resistor and a first diode connected in circuit between the primary winding and the thyristor gate. The first gate control means may also include a second diode connected to the cathode of the ignition thyristor.

In the alternate embodiments discussed above, the second gate control means preferably includes a third diode connected to the thyristor gate and a fourth diode connected to the thyristor cathode. Either or both the third and fourth diodes may be a zener diode to improve the temperature compensation characteristics of the ignition system. The second gate control means may also include a second resistor and a first capacitor connected to the cathode of the fourth diode that provide a time delay to the gating on of the thyristor to improve the primary winding output voltage.

It is a feature and advantage of the present invention to provide an inexpensive capacitive-discharge ignition system which has few components yet advances ignition timing at higher engine speeds.

These and other features of the present invention will be apparent to those skilled in the art from the following detailed description of preferred embodiments and the attached drawings, in which:

DETAILED DESCRIPTION OF THE PREFERRED EMBODIMENTS

A key feature of the present invention is that the charge winding used to charge the charge capacitor is located on a separate, leading pole of the same or a different stator from the pole on which the primary winding is located. The leading and trailing poles may, but need not be adjacent, nor need they be on the same stator. However, it is desirable that the charge and primary windings be disposed so that the charge winding output voltage leads the primary winding output voltage by one-half cycle or more.

Figure 4A:
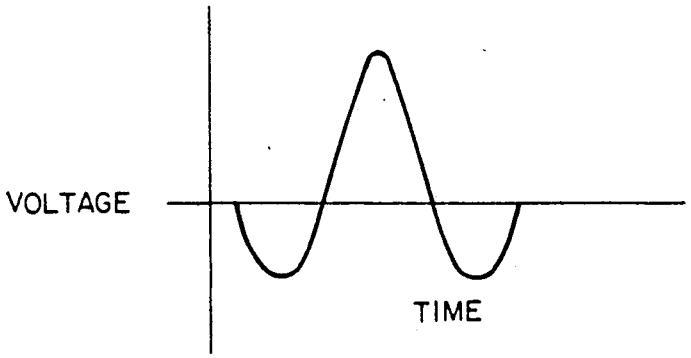
FIG. 4A is a graph depicting typical opencircuit charge winding voltage versus time.
Figure 4B:
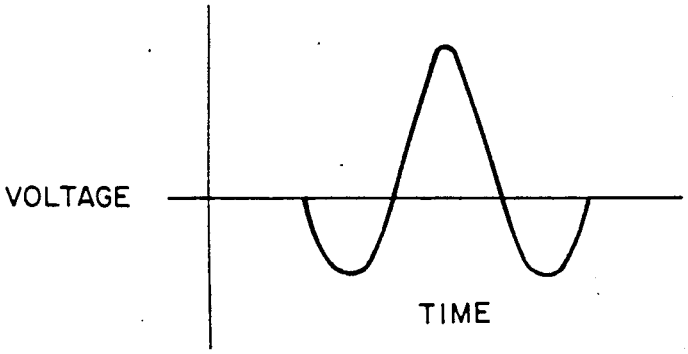
FIG. 4B is a graph depicting typical opencircuit primary winding voltage versus time.

FIG. 4A is a graph depicting typical open-circuit charge winding voltage versus time. FIG. 4B is a similar graph depicting typical primary winding voltage versus time. As seen by comparing FIGS. 4A and 4B, the primary winding output voltage lags the charge winding output voltage by about one-half cycle. It is also seen from FIGS. 4A and 4B that each alternating output signal has a relatively large positive half-cycle, and leading and trailing half-cycles of the opposite or negative polarity.

Another key feature of the present invention is that different components are used to gate on the ignition thyristor (which could be an SCR, triac or other device) at low engine speeds from the components used to gate on the ignition thyristor at higher engine speeds. In the preferred embodiment depicted in FIG. 1, the first gate control means—which gates on the thyristor at low engine speeds of about 500 rpm or less—includes a first resistor R1 and a first diode D1 connected in circuit between primary winding PRW and the gate of thyristor TH1.

Figure 1:
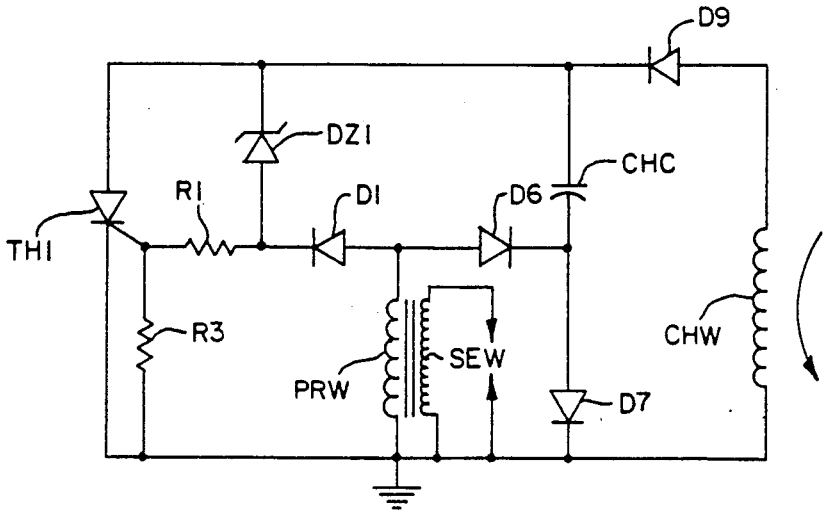
FIG. 1 is a schematic diagram of the preferred embodiment in which the charge winding voltage is used to gate on the ignition thyristor at high engine speeds.

Also in the preferred embodiment depicted in FIG. 1, the second gate control means—which gates on the ignition thyristor at higher engine speeds typically above about 500 rpm—receives and is responsive to the output signal of charge winding CHW. The second gate control means in this embodiment includes a threshold-switching device such as zener diode DZ1.

Figure 2:
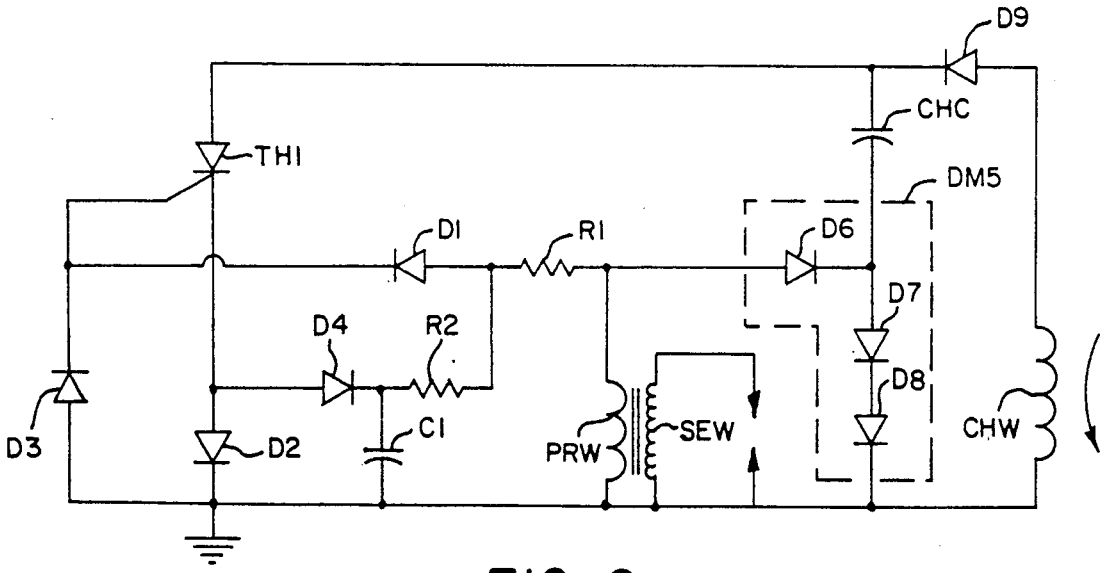
FIG. 2 is a schematic diagram of a second, alternate embodiment in which the primary winding voltage is used to gate on the ignition thyristor at high engine speeds.
Figure 3:
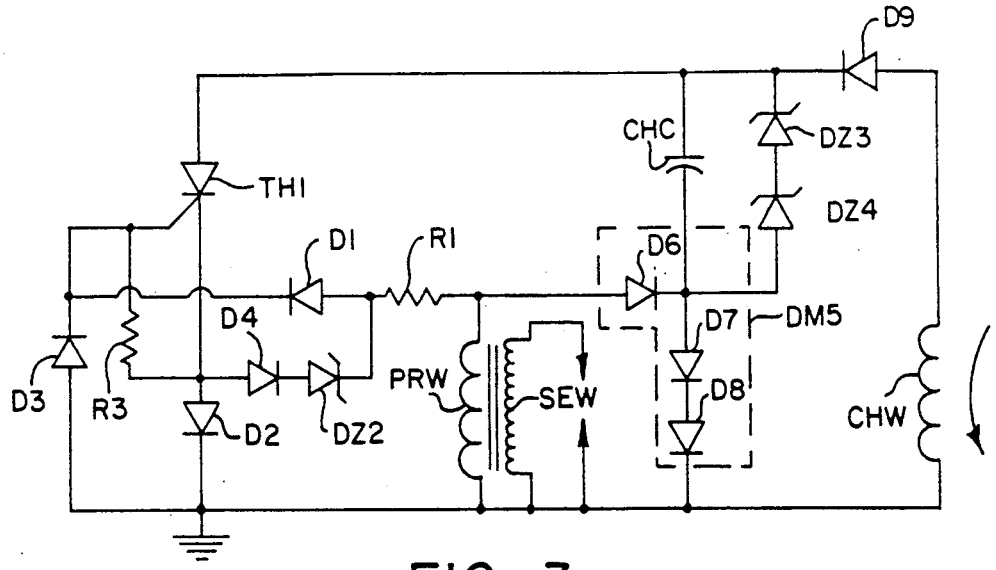
FIG. 3 is a schematic diagram of a third, alternate embodiment in which the primary winding voltage is used to gate on the ignition thyristor at high engine speeds.

The alternate embodiments depicted in FIGS. 2 and 3 gate on the ignition thyristor in response to a primary winding output signal of a first—preferably positive—polarity at low engine speeds, and gate on the ignition thyristor in response to a leading negative voltage signal from the primary winding at higher engine speeds to provide ignition timing advance.

In the embodiments depicted in FIGS. 2 and 3, the first gate control means includes first resistor R1 and first diode D1, as well as a second diode D2 connected to the cathode of the ignition thyristor. The second gate control means includes a third diode D3 connected to the thyristor gate, and a fourth diode D4 connected to the thyristor cathode. The second gate control means may also include a second resistive means connected in series with diode D4 to increase engine speed at which ignition timing advances. The second resistive means may be a second resistor R2, or instead of being a resistor it could be a diode such as zener diode DZ2 (FIG. 3). A first capacitor C1 may also be connected to the cathode of fourth diode D4 which, along with the second resistive means, provides a timing network as further discussed below.

The specific functions of circuit components and the operations of the circuits will now be discussed in more detail with reference to FIGS. 1–3. Components having corresponding functions have been given the same designations in FIGS. 1–3, it being understood that the values of the components may differ in different Figures.

The preferred embodiment depicted in FIG. 1 achieves a primary winding output voltage which reaches a peak at about 500 rpm after ignition timing advances, and remains constant up to at least 3,600 rpm. Approximately 17° of advance or more has been achieved between 200 rpm and 3,600 rpm using this configuration on a Briggs & Stratton engine having a 5.75 inch flywheel, a 0.010 inch stator-to-magnet air gap, a primary winding with 73 turns, a secondary winding with 8,400 turns, and a charge winding with 1,800 turns.

The alternate embodiments depicted in FIGS. 2 and 3 also achieve significant timing advance, but may have the less desirable characteristic of reduced primary and secondary winding output voltages at engine speeds in excess of about 2,500 rpm.

Referring now to FIG. 1, charge winding CHW charges charge capacitor CHC through diodes D9 and D7. Resistor R1 limits current to the gate of thyristor TH1. Diode D1 permits control of thyristor TH1 by the primary winding PRW at low engine speeds and prevents current flow passing through zener diode DZ1 at higher speeds from also going through primary winding PRW, so that the current that does flow through diode DZ1 will also flow through resistor R1 and thyristor TH1.

Diode D6 acts as a return path when charge capacitor CHC discharges through thyristor TH1 and primary winding PRW. While capacitor CHC is charging, diode D6 also prevents current from passing through primary winding PRW. Third resistor R3 is connected between the gate and the cathode of thyristor TH1. Third resistor R3 is desirable primarily when thyristor TH1 is a sensitive-gate thyristor and prevents the thyristor from being improperly gated due to transient signals.

The ignition system depicted in FIG. 1 operates in the following manner. Since charge winding CHW is placed on a leading pole of the stator when compared to the placement of primary winding PRW, the rotating magnet (not shown) will pass charge winding CHW first. As the magnet passes charge winding CHW and a positive-going voltage signal with respect to ground is generated across winding CHW, current flow is established through diode D9 and diode D7 to charge capacitor CHC. Diode D9 also prevents capacitor CHC from discharging back through charge winding CHW after the capacitor reaches its peak value. At low engine speeds, capacitor CHC will charge to approximately the peak value of the charge winding voltage and will remain there until the output voltage in primary winding PRW becomes positive with respect to ground. At that time, the positive primary winding voltage PR; becomes sufficient to overcome the voltage drops across diode D1 and the thyristor TH1 gate-to-cathode voltage. This establishes a current flow through diode D1, resistor R1, and the gate of thyristor TH1.

The current flow in the thyristor gate causes the thyristor to be switched on, allowing charge capacitor CHC to discharge through thyristor TH1, primary winding PRW, and diode D6.

At engine speeds above about 400–500 rpm, the voltage across zener diode DZ1 will become high enough to allow the zener diode to conduct before the peak voltage of charge winding CHW is reached. As soon as the voltage across charge winding CHW exceeds the threshold of zener diode DZ1 as well as the voltage drops across diode D9 and the gate-to-cathode junction of thyristor TH1, current flows through diode DZ1, resistor R1, and the gate-to-cathode junction of thyristor TH1, thereby switching on the thyristor. Thus, at higher engine speeds timing advance is achieved since thyristor TH1 conducts before charge winding CHW achieves its peak voltage, while at lower engine speeds thyristor TH1 was gated on after charge winding CHW reached its peak voltage.

The embodiments depicted in FIGS. 2 and 3 are similar to each other in that their respective operations are similar. They primarily differ from each other in the optional components they include.

Referring now to FIGS. 2 and 3, a fifth diode means DM5 consists of a diode network including diodes D6, D7 and D8. The purpose of these diodes is to limit the reverse voltage across primary winding PRW and thereby increase the spark duration in a spark plug (not shown) connected across secondary winding SEW. The clamping of the reverse primary winding voltage by diodes D6, D7 and D8 prevents undesirable ringing, thus helping extend spark duration. Diodes D6 and D7 perform a similar function in the embodiment depicted in FIG. 1. Capacitor CHC charges through diodes D9, D7 and D8, and discharges through thyristor TH1, diode D2, primary winding PRW, and diode D6. The forward-biased voltage drops across diodes D6, D7 and D8 must be sufficiently high to allow thyristor TH1 to be gated on by its gate control circuitry when voltage is generated across primary winding PRW by the rotating magnet.

In FIG. 2, resistor R2 increases the engine speed at which engine timing advances. When resistor R2 is used in combination with an optional first capacitor C1, the resulting RC network helps maintain high system output voltage at higher engine speeds by providing a short time delay to the thyristor's gate control circuitry. The time delay changes the point at which the thyristor is gated on at higher engine speeds.

In FIG. 3, a second zener diode DZ2 is connected in series with diode D4 to help improve the temperature compensation characteristics at the point at which engine timing advances, and also to increase the engine speed at which timing advances.

Also in FIG. 3, zener diodes DZ3 and DZ4 are two high-voltage diodes used to limit the charge capacitor's charge voltage. Zener diodes DZ3 and DZ4 may be replaced by a single zener diode. With proper design of charge winding CHW in conjunction with the chosen capacitance of charge capacitor CHC, diodes DZ3 and DZ4 are unnecessary. For example, if charge winding CHW has 1,800 turns and the capacitance of charge capacitor CHC is about 1.2 microfarads, zener diodes DZ3 and DZ4 are not required.

The operation of the embodiments depicted in FIGS. 2 and 3 will now be described. In FIGS. 2 and 3, charge winding CHC charges through diodes D9, D7 and D8. Charge capacitor CHC stays fully charged until sufficient positive-polarity voltage is generated across primary winding PRW. When this occurs, thyristor TH1 is gated on through resistors R1 and diodes D1 and D2.

When thyristor TH1 is gated on, capacitor CHC discharges rapidly through the thyristor, diode D2, primary winding PRW, and diode D6. This creates a high voltage across primary winding PRW, and by transformer action creates a very large negative voltage spike across secondary winding SEW to fire the spark plug.

As the engine speed increases, the negative-polarity leading half wave of generated primary winding voltage becomes sufficiently high to gate thyristor TH1 on through diodes D3 and D4 and resistor R1. Engine timing is advanced since the thyristor is now being gated on at an earlier point in response to the negative half-wave which leads the positive half-wave during which the thyristor is gated at lower engine speeds.

Either or both diodes D3 and D4 may be replaced by a forward-conducting zener diode for improved circuit temperature-compensation characteristics.

Although several embodiments of the present invention have been shown and described, other alternate embodiments will be apparent to those skilled in the art and are within the intended scope of the present invention. Thus, the invention is to be limited only by the following claims.

I claim:

1. An advancing capacitive-discharge ignition system for an internal combustion engine, comprising:
- a charge capacitor;
- an ignition thyristor in circuit connection with said charge capacitor and having a gate, an anode and a cathode, said charge capacitor discharging through said ignition thyristor;
- a charge winding located on a leading pole of a stator, said charge winding generating an alternating charge winding signal having positive and negative voltage signals;
- an ignition coil including a primary winding and a secondary winding, said primary winding generating an alternating primary winding voltage signal having a positive voltage signal, a leading negative voltage signal, and a trailing negative voltage signal, said primary winding located on a trailing pole of a stator;
- first gate control means for gating on said ignition thyristor at low engine speeds; and
- second gate control means for gating on said ignition thyristor at high engine speeds to advance ignition timing.

2. The ignition system of claim 1, wherein said first gate control means receives and is responsive to a voltage signal from said primary winding having a first polarity, and wherein said second gate control means receives and is responsive to a voltage signal from said primary winding having a second polarity opposite to said first polarity.

3. The ignition system of claim 2, wherein said voltage signal to which said second gate control means is responsive is a leading negative voltage signal.

4. The ignition system of claim 1, wherein said first gate control means includes:
- a first resistor and a fist diode connected in circuit between said primary winding and said thyristor gate.

5. The ignition system of claim 4, wherein said first gate control means also includes:
- a second diode connected to the cathode of said ignition thyristor.

6. The ignition system of claim 1, wherein said second gate control means includes:
- a first diode connected to said thyristor gate; and
- a second diode connection to the said thyristor cathode.

7. The ignition system of claim 6, wherein either said first diode or said second diode is a zener diode that improves the temperature compensation characteristics of said ignition system.

8. The ignition system of claim 6, further comprising:
- a resistive means connected in series with said second diode that increases the engine speed at which ignition timing advances.

9. The ignition system of claim 6, wherein said second gate control means also includes:
- a first capacitor connected to the cathode of said second diode.

10. The ignition system of claim 1, wherein said charge winding and said primary winding are located on adjacent poles of the same stator.

11. The ignition system of claim 1, wherein said alternating primary winding signal lags said alternating charge winding signal by at least one-half cycle.

12. The ignition system of claim 1, wherein said thyristor is a sensitive-gate SCR, and further comprising:
- a third resistive means for preventing the improper gating of said SCR.

13. The ignition system of claim 1, further comprising:
- diode means connected to said primary winding for clamping said primary winding voltage signal to increase the spark duration of a spark plug connected across said secondary winding.

14. The ignition system of claim 1, wherein said first gate control means receives and is responsive to said primary winding signal, and wherein said second gate control means receives and is responsive to said charge winding signal.

15. The ignition system of claim 1, wherein
- said second gate control means includes a threshold-switching device.

16. The ignition system of claim 15, wherein said threshold-switching device is a zener diode.

* * * * *